US009052142B2

(12) United States Patent
Kim et al.

(10) Patent No.: US 9,052,142 B2
(45) **Date of Patent: *Jun. 9, 2015**

(54) CABINET DRUM DRYER FILTER BRUSH

(71) Applicant: LG Electronics Inc., Seoul (KR)

(72) Inventors: Jeongyun Kim, Seoul (KR); Sangik Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 149 days.

This patent is subject to a terminal disclaimer.

(21) Appl. No.: 13/709,323

(22) Filed: Dec. 10, 2012

(65) Prior Publication Data

US 2013/0145638 A1 Jun. 13, 2013

(30) Foreign Application Priority Data

Dec. 8, 2011 (KR) ..... 10-2011-0131006
Dec. 19, 2011 (KR) ..... 10-2011-0137562
Jan. 5, 2012 (KR) ..... 10-2012-0001670

(51) Int. Cl.
*F26B 21/00* (2006.01)
*D06F 58/18* (2006.01)
*D06F 58/22* (2006.01)

(52) U.S. Cl.
CPC ..... *F26B 21/003* (2013.01); *D06F 58/22* (2013.01)

(58) Field of Classification Search
CPC ..... F26B 3/00; F26B 5/00; F26B 9/00; F26B 21/00; D06F 35/00; D06F 58/00; D06F 58/02; D06F 58/18
USPC ..... 34/595, 601, 606, 610; 68/5 C, 5 R, 19, 68/20; 8/132, 149, 159; 134/181, 199, 200
See application file for complete search history.

(56) References Cited

U.S. PATENT DOCUMENTS 2,743,532 A * 5/1956 Steward ..... 34/547
3,122,426 A * 2/1964 Horecky ..... 34/531
3,872,534 A * 3/1975 Hoag ..... 15/88.1

(Continued)

FOREIGN PATENT DOCUMENTS

CN 2448866 Y 9/2001
CN 101100802 A 1/2008

(Continued)

OTHER PUBLICATIONS

PCT International Search Report dated Mar. 25, 2013 for Application No. PCT/KR2012/010645, 10 pages.

(Continued)

*Primary Examiner* — Steve M Gravini
(74) *Attorney, Agent, or Firm* — Fish & Richardson P.C.

(57) ABSTRACT

A dryer includes a cabinet, a drum rotatably provided in the cabinet, a duct that defines a flow passage for air exiting the drum, and a filter assembly located at a position relative to the flow passage and contacting air that has exited the drum. The filter assembly includes a case defining the filter assembly, a filter portion configured to filter foreign substance from the air contacting the filter assembly, a brush frame configured for rotational movement relative to the case about a rotational axis, and a brush that is supported by the brush frame and configured to separate the foreign substance from the filter portion. A first distance from a first side of the case to the rotational axis of the brush frame is longer than a second distance from a second side of the case to the rotational axis of the brush frame.

20 Claims, 17 Drawing Sheets

(56) References Cited

U.S. PATENT DOCUMENTS

| | | | | | |
|---|---|---|---|---|---|
| 4,069,536 | A * | 1/1978 | Hartz et al. | 15/104.92 |
| 4,380,839 | A * | 4/1983 | Caradonna | 15/104.92 |
| 4,472,851 | A * | 9/1984 | Kinsey | 15/88.3 |
| 4,676,839 | A * | 6/1987 | Osborn | 134/25.4 |
| 5,006,136 | A * | 4/1991 | Wetter | 55/290 |
| 5,168,888 | A * | 12/1992 | Altwasser | 134/181 |
| 7,305,775 | B2 * | 12/2007 | Favret et al. | 34/82 |
| 7,891,113 | B2 | 2/2011 | Oh | |
| 8,240,064 | B2 * | 8/2012 | Steffens | 34/480 |
| 8,387,268 | B2 | 3/2013 | Ahn | |
| 8,789,287 | B2 * | 7/2014 | Kim et al. | 34/82 |
| 2006/0005582 | A1 | 1/2006 | Lee | |
| 2008/0313923 | A1 | 12/2008 | Oh | |
| 2009/0064528 | A1 | 3/2009 | Kim | |
| 2010/0154241 | A1 | 6/2010 | Ahn | |
| 2011/0154587 | A1 * | 6/2011 | Kim | 15/21.1 |
| 2011/0225837 | A1 | 9/2011 | Ahn | |
| 2011/0225838 | A1 | 9/2011 | Ahn | |
| 2011/0271542 | A1 | 11/2011 | Ko | |
| 2011/0271543 | A1 | 11/2011 | Kim | |
| 2013/0145638 | A1 * | 6/2013 | Kim et al. | 34/82 |

FOREIGN PATENT DOCUMENTS

| | | | |
|---|---|---|---|
| CN | 101173442 | A | 5/2008 |
| CN | 101173482 | A | 5/2008 |
| CN | 101187141 | A | 5/2008 |
| CN | 101289799 | A | 10/2008 |
| CN | 101760944 | A | 6/2010 |
| CN | 201897375 | U | 7/2011 |
| CN | 102257207 | A | 11/2011 |
| CN | 102257208 | A | 11/2011 |
| DE | 19924297 | A1 | 11/2000 |
| DE | 102006060031 | A1 | 6/2008 |
| EP | 1 614 792 | A1 | 1/2006 |
| EP | 1 719 833 | A1 | 11/2006 |
| EP | 2 365 122 | A1 | 9/2011 |
| JP | 06-091096 | A | 4/1994 |
| JP | 06-098993 | A | 4/1994 |
| JP | 07-000694 | A | 1/1995 |
| JP | 2008-194439 | A | 8/2008 |
| KR | 10-0664507 | B1 | 1/2007 |
| KR | 10-2011-0123359 | A | 11/2011 |
| RU | 69524 | U1 | 12/2007 |
| WO | WO 2008/074581 | A | 6/2008 |
| WO | WO 2008/074581 | A1 | 6/2008 |
| WO | WO 2010/071354 | A2 | 6/2010 |
| WO | WO 2010/071355 | A2 | 6/2010 |
| WO | WO 2011/147009 | A2 | 12/2011 |
| WO | WO 2013085350 | * | 6/2013 |

OTHER PUBLICATIONS

PCT International Search Report dated Mar. 25, 2013 for Application No. PCT/KR2012/010646, 11 pages.

Russian Decision of Grant dated Mar. 31, 2014 for Application No. 2013128376, with English Translation, 17 pages.

PCT International Search Report dated Apr. 29, 2013 for Application No. PCT/KR2012/010652, 8 pages.

PCT International Search Report and Written Opinion for Application No. PCT/KR2012/010646, dated Mar. 25, 2013, 8 pages.

Russian Decision on Grant dated Nov. 11, 2014 for Russian Application No. 2013127288, with English Tanslation, 16 pages.

Chinese Office Action dated Jan. 22, 2015, for Chinese Application No. 201280003766.4, with English Translation, 13 pages.

Chinese Office Action dated Feb. 27, 2015, for Chinese Application No. 201280003746.7, with English Translation, 22 pages.

Chinese Office Action dated Mar. 4, 2015 for Chinese Application No. 201280007214.0, with English Translation, 10 Pages.

* cited by examiner (a)

(b)

CABINET DRUM DRYER FILTER BRUSH

CROSS REFERENCE TO RELATED APPLICATION

This application claims the benefit of Korean Patent Application Nos. KR10-2011-0131006, filed on Dec. 8, 2012, KR10-2011-0137562, filed on Dec. 19, 2011 and KR10-2012-0001670 filed on Jan. 5, 2012, which are hereby incorporated by reference as if fully set forth herein.

TECHNICAL FIELD

This application relates to a dryer having a filter assembly provided thereto for removing foreign substance from air discharged from a drum.

BACKGROUND

In general, a dryer is a machine for drying laundry by introducing the laundry, after washing, to a drum, or tub, for spinning while supplying heated air to inside the drum to evaporate moisture from the laundry.

The air discharged to an outside of the drum from the inside of the drum, after exchanging heat with and absorbing moisture from the laundry, attains higher humidity and temperature. Dryers may be classified according to the system used for treating the humid and high temperature air. For example, the dryer may be an exhaust type dryer that discharges the humid and high temperature air from the drum to an outside of the dryer. Additionally, the dryer may be a condensing type dryer in which a heat exchanger condenses and heats the air from the drum, and in which the humid and high temperature air is re-supplied to the drum (i.e., the air from the drum is circulated).

The air being discharged from the drum during drying may contain foreign substances, such as lint or the like, coming from the object being dried, such as clothes. The foreign substance can harm the dryer if passed through mechanical elements of the dryer, and can also pollute outdoor air if discharged to an outside of the dryer. Therefore, the dryer is required to remove the foreign substance from the air being discharged from the drum.

In general, a filter provided to the dryer is positioned on a front of the drum for filtering the foreign substance from the air discharged from the drum. Accordingly, if the dryer is used continuously, the filter may accumulate the foreign substance, such as lint, thereon.

If the accumulation of the foreign substance on the filter becomes greater than a preset level, the foreign substance can interfere with the discharge of the air from the drum; thus, the filter in the dryer should be cleaned periodically. The filter cleaning is carried out as the user separates the filter from the dryer after finishing a drying cycle, removes the foreign substance from the filter, and again mounts the filter to the dryer.

However, such filter cleaning carried out manually is not only cumbersome but also, because the filter cleaning may not be carried out every time the dryer is operated, can lead to, until the filter is cleaned, a failure to secure adequate air flow rate required for drying due to the foreign substance interfering with the air flow being discharged from the drum.

SUMMARY

According to one aspect, a dryer includes a cabinet, a drum rotatably provided in the cabinet, a duct that defines a flow passage for air exiting the drum, and a filter assembly located at a position relative to the flow passage and contacting air that has exited the drum. The filter assembly includes a case defining the filter assembly, a filter portion configured to filter foreign substance from the air contacting the filter assembly, a brush frame configured for rotational movement relative to the case about a rotational axis, and a brush that is supported by the brush frame and configured to separate the foreign substance from the filter portion. A first distance from a first side of the case to the rotational axis of the brush frame is longer than a second distance from a second side of the case to the rotational axis of the brush frame.

Implementations of this aspect may include one or more of the following features. For example, the first and second sides of the case may be on opposite horizontal ends of the case. The dryer may further include a fan located at a position relative to the flow passage and configured to discharge air that has contacted the filter assembly. The fan may be positioned closer to the first side of the case than the second side of the case. The filter portion may include a filter cleaning region within which the rotational movement of the brush frame is confined, and a foreign substance compression region configured to receive the foreign substance that has separated from the filter portion. A first area of the foreign substance compression region located on a first side of the rotational axis may be less than a second area of the foreign substance compression region located at a second side of the rotational axis. At least a portion of the foreign substance compression region may be located above the rotational axis of the brush frame. At least a portion of the foreign substance compression region may be located below the rotational axis of the brush frame. The filter portion may have a circular shape with a center located at the rotational axis of the brush frame. A length of the brush frame may be substantially equal to a radius of the filter portion. The dryer may further include a magnet supported by the brush frame, a first sensor supported by the cases, and a second sensor supported by the case. The first sensor may be located at a first end point of a range of rotational movement of the brush frame, and may be configured to sense a magnetic force generated by the magnet. The second sensor may be located at a second end point of the range of rotational movement of the brush frame, and may be configured to sense the magnetic force generated by the magnet. The dryer may further include a plurality of radial frames extending radially outward from the rotational axis of the brush frame. At least two of the plurality of radial frames may each include a plurality of projections spaced apart from one another along a length of the radial frame, and the plurality of projections may be configured to separate the foreign substance from the brush. Each of the plurality of projections on a first radial frame may include a first sloped surface, and each of the plurality of projections on a second radial frame may include a second sloped surface. The first and second sloped surfaces may be oriented to substantially face each other. The case may include a first case portion having a first filter portion, and a second case portion having a second filter portion. The first and second case portions may be configured to face each other and may define a space therebetween. The brush frame may be configured to rotate within the space, and the brush may be provided on opposite sides of the brush frame to separate the foreign substance from both the first and second filter portions. The brush frame may define grooved seating portions on opposite sides, and the brush may include a body portion configured to be seated within the seating portion and a plurality of brush projections projecting outward from the body portion. The plurality of brush projections may be spaced apart from one another at predetermined intervals. The brush frame may include a rotation shaft along the rotational axis. A surface of one of the first and second case portions may include a gear seating portion protruding toward the other of the first and second case portions. A brush driving gear may be seated in the gear seating portion and may be attached to the rotation shaft. The dryer may further include a brush driving motor, and a motor gear coupled to a rotation shaft of the brush driving motor. The motor gear may further be coupled to the brush driving gear. A straight line connecting a rotational axis of the brush driving gear and a rotational axis of the motor gear may be oriented at a predetermined angle with respect to a straight line vertical to the ground. The rotational axis of the brush frame may be horizontally offset with respect to a vertical center line of the filter portion. A first range of rotational movement of the brush frame from a vertical position toward a first side of the case may be greater than a second range of rotational movement of the brush frame from the vertical position toward a second side of the case.

According to another aspect, a dryer includes a cabinet, a drum rotatably provided in the cabinet, a duct that defines a flow passage for air exiting the drum, and a filter assembly located at a position relative to the flow passage and contacting air that has exited the drum. The filter assembly includes a case defining the filter assembly, a filter portion configured to filter foreign substance from the air contacting the filter assembly, a brush frame configured for rotational movement relative to the case about a rotational axis, and a brush that is supported by the brush frame and configured to separate the foreign substance from the filter portion. The rotational axis of the brush frame is horizontally offset with respect to a vertical center line of the filter portion.

According to another aspect, a dryer includes a cabinet, a drum rotatably provided in the cabinet, a duct that defines a flow passage for air exiting the drum, and a filter assembly located at a position relative to the flow passage and contacting air that has exited the drum. The filter assembly includes a case defining the filter assembly, a filter portion configured to filter foreign substance from the air contacting the filter assembly, a brush frame configured for rotational movement relative to the case about a rotational axis, and a brush that is supported by the brush frame and configured to separate the foreign substance from the filter portion. A first range of rotational movement of the brush frame from a vertical position toward a first side of the case is greater than a second range of rotational movement of the brush frame from the vertical position toward a second side of the case.

According to another aspect, a dryer includes a cabinet, a drum rotatably provided in the cabinet, a duct that defines a flow passage for air exiting the drum, and a filter assembly located at a position relative to the flow passage and contacting air that has exited the drum. The filter assembly includes a case defining the filter assembly, a filter portion configured to filter foreign substance from the air contacting the filter assembly, a brush frame configured for rotational movement relative to the case about a rotational axis, and a brush that is supported by the brush frame and configured to separate the foreign substance from the filter portion. The filter portion has a filter cleaning region and a foreign substance compression region. The rotational movement of the brush frame is confined within the filter cleaning region. The foreign substance compression region is configured to receive the separated foreign substance. A first area of the foreign substance compression region located on a first side of the rotational axis is less than a second area of the foreign substance compression region located at a second side of the rotational axis.

According to another aspect, a dryer includes a cabinet, a drum rotatably provided in the cabinet, a duct that defines a flow passage for air exiting the drum, and a filter assembly located at a position relative to the flow passage and contacting air that has exited the drum. The filter assembly includes a case defining the filter assembly, a filter portion configured to filter foreign substance from the air contacting the filter assembly, a brush frame configured for rotational movement relative to the case about a rotational axis, and a brush that is supported by the brush frame and configured to separate the foreign substance from the filter portion. The filter portion has a filter cleaning region and a foreign substance compression region. The rotational movement of the brush frame is confined within the filter cleaning region. The foreign substance compression region is configured to receive the separated foreign substance. At least a portion of the foreign substance compression region is located above the rotational axis of the brush frame, and at least a portion of the foreign substance compression region is located below the rotational axis of the brush frame.

ADVANTAGEOUS EFFECTS

The dryer described in this application may have at least the following advantageous effects.

The dryer described in this application can have an effect of maintaining the air flow rate passing through the filter high for a long time period to improve filter cleaning efficiency by determining a shape of the filter portion and a working range of the brush while taking into account an air filtering rate that varies with a position of the fan.

Additionally, the dryer described in this application can enhance drying efficiency of the dryer by preventing the air flow rate passing through the filter portion from dropping.

Additionally, the dryer described in this application can increase a filter cleaning time period by making the brush to clean the filter more effectively and to compress the foreign substance accumulated on the bottom of the case, more effectively.

Additionally, the dryer described in this application can determine an amount of the foreign substance accumulated in the filter assembly by sensing movement of the brush with the lead switch, and sensing malfunction of the filter assembly.

Additionally, the dryer described in this application can prevent the filter portion cleaned by the brush from breaking, and filter cleaning efficiency can be improved by separating the foreign substance from the brush only in a region of the filter portion from which the foreign substance cannot be removed by the brush.

Additionally, the dryer described in this applicatoin can spread the foreign substance accumulated on the bottom of the case by making the scraper to separate the foreign substance from the brush, gradually.

Additionally, the dryer described in this application can enhance filter cleaning efficiency by enlarging a filter portion area that the air passes through to make the air flow rate high, and enabling two side cleaning with the brush.

Additionally, the dryer described in this application can prevent interference or breakage of the filter assembly that can occur when the filter assembly is being mounted to the dryer.

It is to be understood that both the foregoing general description and the following detailed description are exemplary and explanatory.

BRIEF DESCRIPTION OF THE DRAWINGS

The accompanying drawings, which are included to provide a further understanding of the disclosure and are incorporated in and constitute a part of this application, serving together with the description to explain various aspects of technology. In the drawings.

DETAILED DESCRIPTION

Reference will now be made in detail to various specific implementations and examples, illustrations of which are provided in the accompanying drawings. In general, the same reference numbers are used throughout the drawings to refer to the same or like parts.

Furthermore, a configuration or a control method of a device described hereinafter is provided only for describing example implementations, but not for limiting scope of patent rights.

Figure 1:
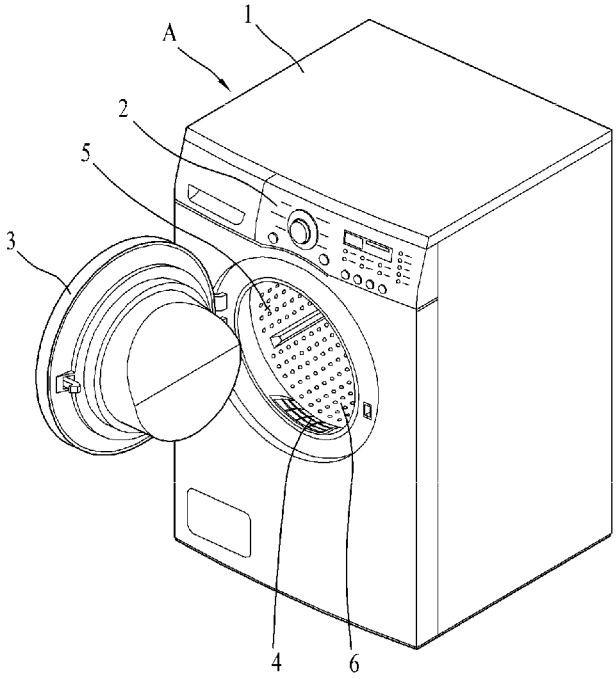
FIG. 1 illustrates a schematic view of an exterior appearance of a dryer.

FIG. 1 illustrates a schematic view of a dryer. As shown in FIG. 1, a dryer A includes a body or a cabinet 1 which forms an exterior appearance of the dryer, and a drum 6 rotatably provided in the cabinet having an inside circumferential surface with a plurality of lifters projecting therefrom. Formed in a front of the body, there is an opening 5 for introduction objects to be dried, such as clothes, to an inside of the body.

The opening 5 can be opened and closed by a door 3, and positioned above the opening 5 is a control panel 2 having different operation buttons and a display unit arranged thereon for operating the dryer.

Figure 2:
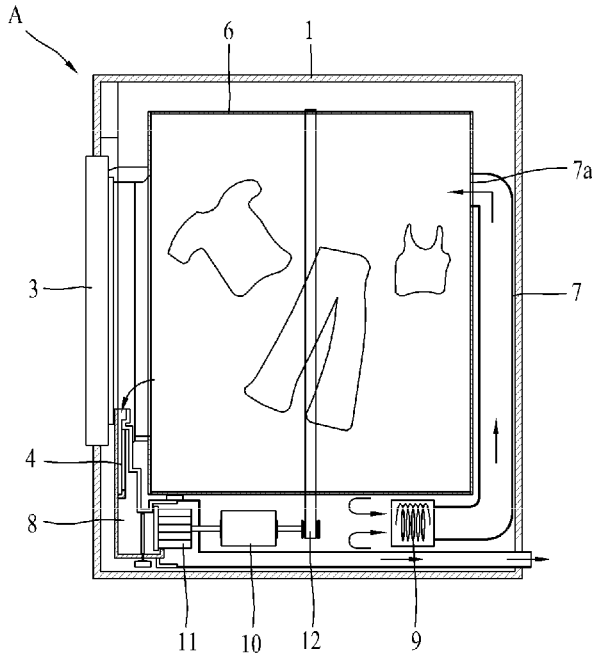
FIG. 2 illustrates a schematic view of an inside of the dryer.

FIG. 2 illustrates a schematic view of an inside of the dryer. As shown in FIG. 2, the drum 6 is rotatably mounted in the cabinet 1 for holding drying objects therein for drying the same. The drum 6 is rotatably supported at its front and rear by supporters (not shown).

The drum 6 is connected to a driving motor 10 provided under the dryer via a power transmission belt 12 such that a rotating force applied is applied to the drum 6. In order to drive the drum, one side of the driving motor 10 is provided with a pulley that has the power transmission belt 12 connected thereto.

Mounted behind the drum 6 is a suction air duct 7 that is connected to heating means 9 for heating the air entering the drum 6. The suction air duct 7 is connected to a rear side of the drum via an outlet 7*a*, and the air heated by the heating means 9 is supplied to the drum through the outlet 7*a*.

Mounted under a front side of the drum 6 are a filter 4 for filtering foreign substance, such as lint or the like, from the air being discharged from the drum and contacting the filter 4, and an air discharge duct 8 for discharging the air, from which the foreign substance has been removed, to an outside of the cabinet 8. The air discharge duct 8 defines a flow passage for air exiting the drum 6.

While the example shown in FIG. 2 illustrates an exhaust type dryer which discharges the air being discharged from the drum to an outside of the dryer, the dryer is also applicable to a circulating type dryer (i.e., the air discharge duct is connected to the air suction duct, and heat exchange means is provided, which enables condensing and heating of the air introduced to the air discharge duct) that supplies the air discharged from the drum back to the drum.

The air discharge duct 8 has a fan 11 for making the air move from the inside of the drum 6 to the air discharge duct. For example, in a case of the exhaust type dryer in FIG. 2, the air discharge duct serves to lead the air forcibly blown by the fan 11 to an outside of the dryer. However, in a case of the circulating type dryer, the air discharge duct is connected to the air suction duct to lead the air blown to the drum through the air suction duct.

Figure 3:
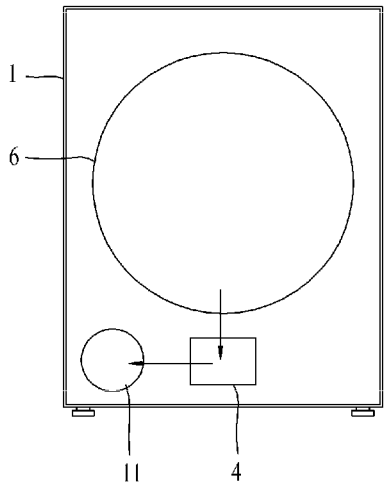
FIG. 3 illustrates a schematic view showing positions of a fan and a filter assembly in a dryer.

In some cases, the fan 11 is provided to a side of the drum. FIG. 3 illustrates a mounted position of the fan 11 when the dryer is seen from a front. As shown in FIG. 3, the fan is positioned not at a center of the dryer but at a side of the dryer. This is because the fan being positioned between an outside circumference of the drum and a corner of the cabinet can maximize spatial efficiency.

The air heated with the heating means is supplied to the drum through the air suction duct. The air supplied to the drum is used for drying the drying objects in the drum. The air used for the drying absorbs moisture from the drying objects to become humid air, and the air in the drum is introduced to, and filtered at, the filter 4 provided at a periphery of the opening 5 positioned at the front of the drum.

In other words, after being introduced to the filter as shown with an arrow in FIG. 3, the air in the drum moves toward the fan positioned on a side of the drum, and the air moved toward the fan thus moves along the air discharge duct.

Figure 4:
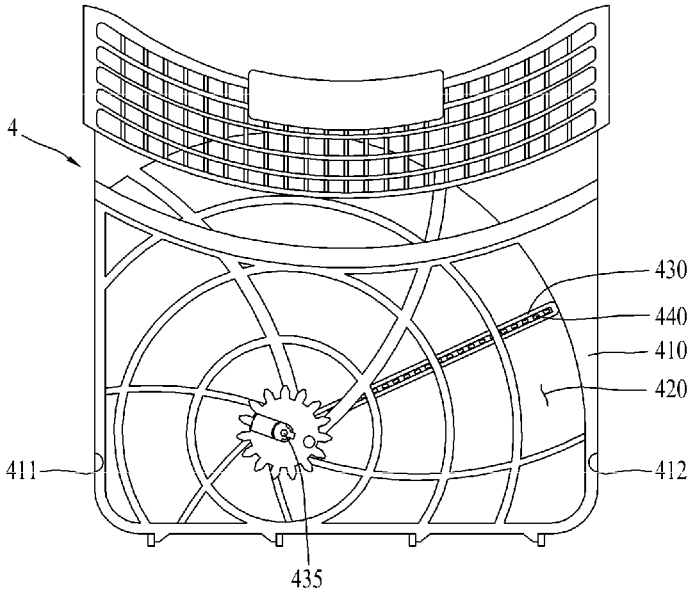
FIG. 4 illustrates a front view of a filter.

The filter 4 includes various elements that are coupled together. Therefore, in description hereafter, the filter 4 will be referred to as a filter assembly 4. FIG. 4 illustrates an example of the filter assembly 4. The filter assembly 4 is detachably mounted to the cabinet 1 at the front of the drum 6 or the periphery of the opening 5. The filter assembly in FIG. 4 shows a state in which the filter assembly is separated from the cabinet 1.

Referring to FIG. 4, the filter assembly 4 includes a case 410 which forms an exterior appearance of the filter assembly 4, a filter portion 420 provided to the case for filtering the foreign substance from the air being discharged from the drum and contacting the filter assembly 4, a brush frame 430 rotatably provided to the case and configured for rotational movement about a rotational axis, and a brush 440 provided to the brush frame 430 for separating the foreign substance from the filter portion.

Figure 5:
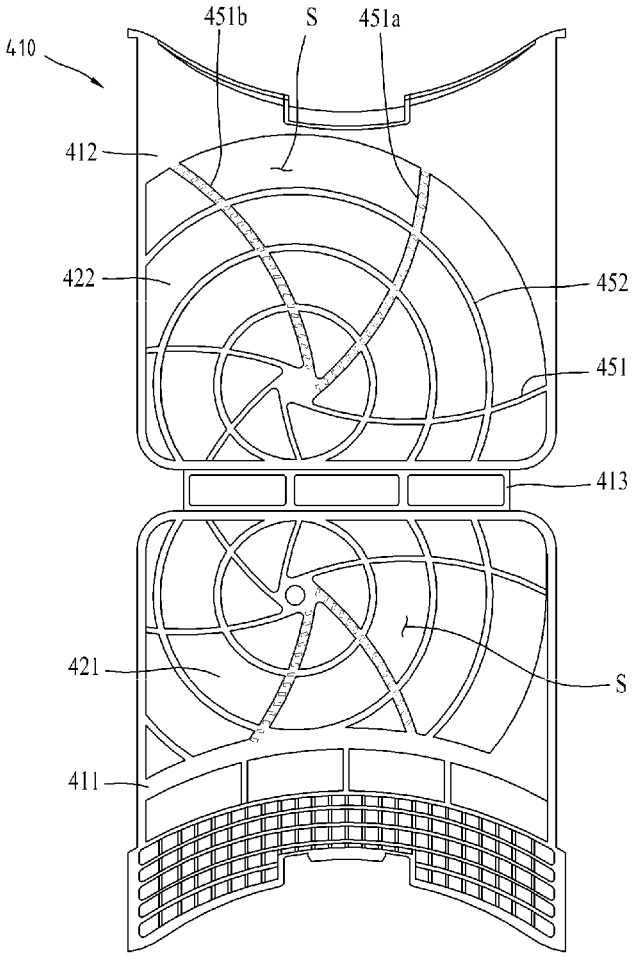
FIG. 5 illustrates a developed view of a case of the filter assembly in FIG. 4.

The case 410 forms an exterior appearance of the filter assembly. FIG. 5 illustrates the case 410 of the filter assembly. As shown in FIG. 5, the case 410 has a first case 411 and a second case 412 opposite to each other. The first case and the second case are connected with a bottom 413 on a lower side of the case 410.

Additionally, each of the first case and the second case has a foldable connection portion to the bottom. Therefore, the first case and the second case are folded to face each other with a predetermined gap therebetween to form a box shape which forms a space. Though not shown, a side having a width the same with the bottom is formed on a side of each of the first case and the second case to maintain a gap between sides of the first case and the second case.

The filter portion 420 is provided to at least one side of the case to pass the air from the drum, leaving the foreign substance contained in the air to the filter as the air passes through the filter portion. Therefore, the case 410 may have an opening S formed therein and a mesh type filter member that covers the opening S, thus forming the filter portion 420.

As described previously, if the case 410 is constructed of the first case 411 and the second case 412, the filter portion 420 may be provided to the first case 411 and the second case 412, respectively. That is, as shown in FIG. 5, the first case 411 may have a first filter portion 421 provided thereto and the second case 412 may have a second filter portion 422 provided thereto.

The brush 440 and the brush frame 430 are rotatably provided between the first case and the second case for separating the foreign substance from the filter portion 420. FIGS. 6 to 9 illustrate the brush and the brush frame, in detail.

Figure 6:
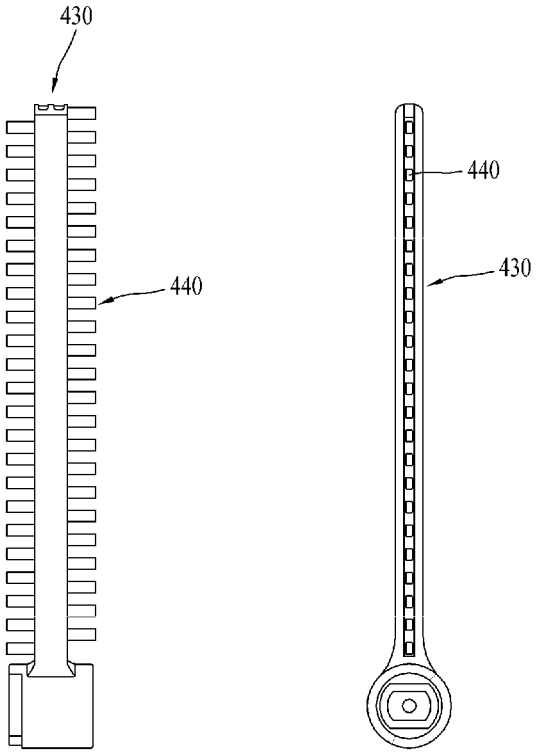
FIG. 6 illustrates schematic views of a brush and a brush frame of the filter assembly in FIG. 4.
Figure 7:
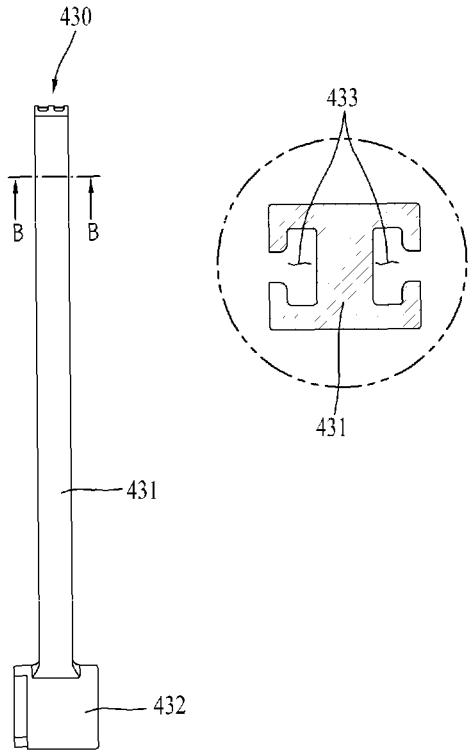
FIG. 7 illustrates a schematic view of the brush frame in FIG. 6.

FIG. 6 illustrates a state in which the brush is coupled to the brush frame. FIG. 7 illustrates the brush frame separated from the brush. As shown in FIG. 7, the brush frame 430 has a frame portion 431 having a rod shape and a center portion 432 at a lower side of the frame portion to form a rotation center of the frame portion.

FIG. 7 also shows a cross section B-B of the frame portion 431. As shown in the cross section of the frame portion, the frame portion 431 has a groove formed in both sides of the frame portion 431 along a length direction thereof, which are seating portions 433 for seating the brushes 440 therein, respectively.

Figure 8:
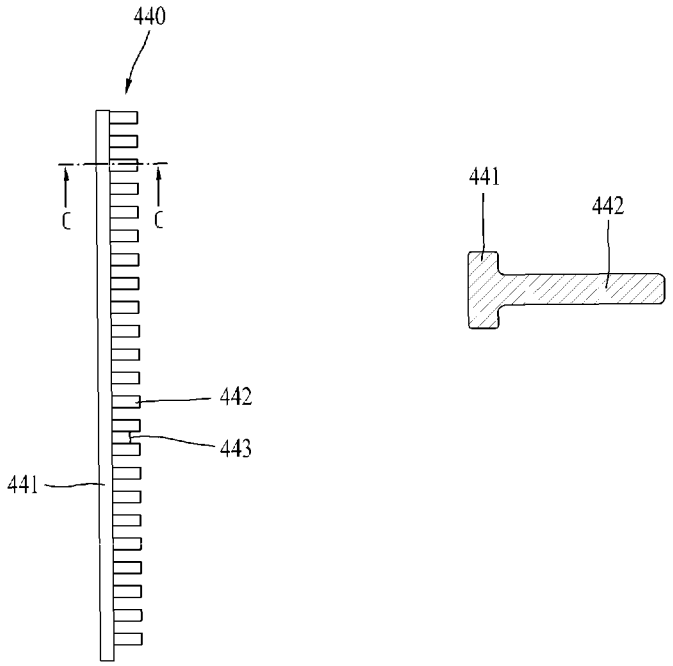
FIG. 8 illustrates a schematic view of the brush in FIG. 6.

FIG. 8 illustrates the brush 440 in greater detail. As shown in FIG. 8, the brush 440 has a body portion 441 seated in the seating portion 433, and a plurality of brush projections 442 extending from the body portion.

Referring to a cross section C-C of the brush in FIG. 8, a width of the body portion 441 is larger than a width of the brush projection 442. Accordingly, upon pushing the body portion 441 into the seating portion 433 through a top side of the frame portion 431, the body portion 441 seats in, and is secured to, the seating portion 433 thereby exposing the brush projections 442 to an outside of the seating portion 443.

Figure 9:
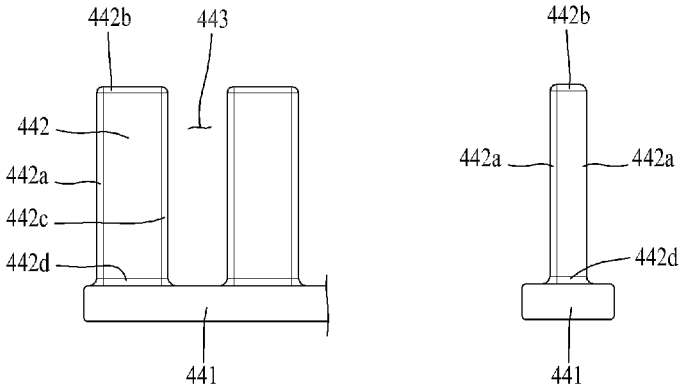
FIG. 9 illustrates a partial enlarged view of the brush in FIG. 6.

The brush projections 442 are spaced a predetermined gap from one another to provide a space 443 between one brush projection and an adjacent other brush projection. FIG. 9 illustrates the brush projection 442 in more detail. The brush projection can have a curved outside circumference. FIG. 9 illustrates the brush projection having curved left edges 442*a*, top edges 442*b*, and right edges 442*c*. Moreover, a joined portion 442*d* between the brush projection 442 and the body portion 441 may also be curved.

Referring again to FIG. 6, the brush 440 is provided to both sides of the brush frame 430 (i.e., opposite sides of the brush frame), enabling both the first filter portion 421 and the second filter portion 422 to separate the foreign substance, thus enlarging an area of the filter portion through which the air passes to make an air flow rate higher and to enable simultaneous cleaning of the first filter portion and the second filter portion to enhance drying efficiency. The enhancement in drying efficiency may be due to sustenance or increased air flow rate.

Additionally, the brush projections 442 at opposite sides of the brush frame 430 may be provided such that one of the brush projections 442 at one side of the brush frame 430 is on a same line with the space 443 formed in the other side of the brush frame 430. That is, the brush projections 442 may be alternately projecting from opposite sides of the brush frame 430.

Additionally, though not shown in FIG. 6, the brush projections 442 positioned at one side of the brush frame 430 may be positioned parallel with the brush projections 442 formed on the other side of the brush frame 430. That is, the brush projections 442 may be provided symmetric with respect to the brush frame 430. This is for easy removal of the foreign substance from the brush 440 with scrapers 451*a* and 451*b* as described below.

In some cases, the filter assembly 4 has a plurality of radial frames 451 formed radially with reference to a rotation center, or rotational axis, of the brush frame 430 at the filter portion 420. Additionally, there are a plurality of concentric frames 452 formed to have a center that is aligned with the rotational axis of the brush frame to connect the radial frames 451. The radial frames and the concentric frames 452 are shown in FIG. 5.

As shown in FIG. 5, the radial frame 451 may have a curved shape extending from the rotation center of the brush frame to an outside of the opening S.

Figure 10:
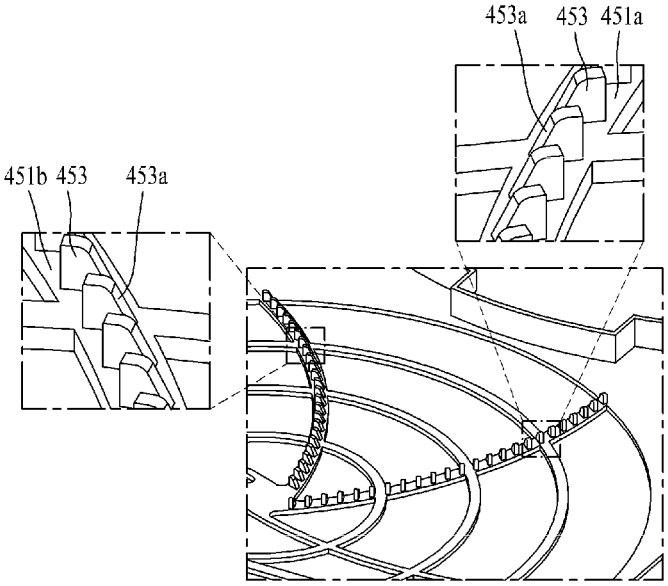
FIG. 10 illustrates a schematic view of a scraper formed on a filter portion of the filter assembly in FIG. 4.

As shown, at least two of the radial frames 451 have a plurality of projections 453 formed spaced from one another along a length direction thereof, respectively. FIG. 10 illustrates the radial frames each having the projections formed thereon.

Referring to FIG. 10, one of the radial frames having the plurality of the projections 453 formed thereon may be referred to as a first scraper 451*a* and the other one may be referred to as a second scraper 451*b*.

Figure 11:
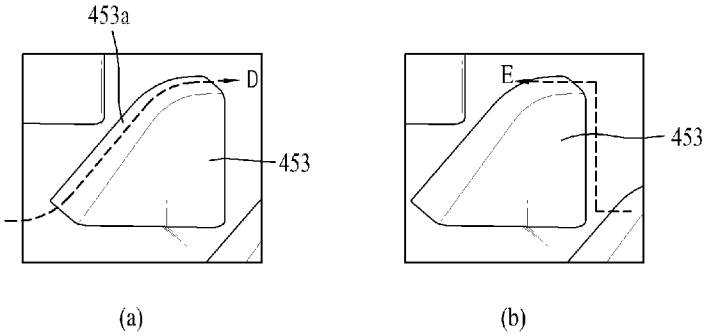
FIG. 11 illustrates a schematic view of projections of the scraper in FIG. 10.

FIG. 11 illustrates the projection 453 in detail. The projection 453 forms a sloped side or surface 453*a* along a moving path of the brush. In this case, as shown in FIG. 10, the sloped side of the projection formed on the first scraper 451*a* is opposite to and facing the sloped side of the projection formed on the second scraper 451*b*.

The foreign substance left at the brush 440 may be separated from the brush 440 when the brush 440 is brought into contact with the projections 453. Thus, if the brush 440 moves in contact with a surface of the filter portion 420, the foreign substance is separated from the surface of the filter portion by the brush projections 442, and moves together with the brush caught at the brush projections 442.

Referring to FIG. 11A, if the brush moves riding on the sloped surface of the projection, the foreign substance passes through the first scraper and the second scraper while continuing to be caught at the brush projection as before.

However, the rotary reciprocating movement of the brush frame makes the brush to be in contact with the projection 453 again, and, as shown in FIG. 11B, if the brush passes a corner, the foreign substance caught at the brush projection 442 is separated from the brush projection.

Additionally, the space 443 formed between the brush projections 442 can lead to a smooth separation of the foreign substance from the brush when the brush 440 and the projection cross each other.

Figure 12:
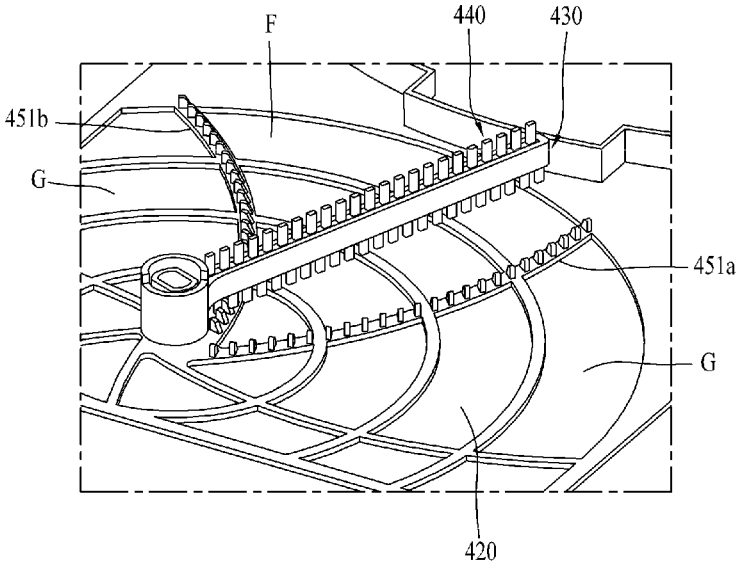
FIG. 12 illustrates a perspective view showing filter cleaning by driving a brush and a brush frame in the filter assembly in FIG. 4.

FIG. 12 illustrates a state in which the filter portion is cleaned by the rotary reciprocating movement of the brush frame 430. As shown in FIG. 12, since the projections formed on the first scraper 451*a* and the projections formed on the second scraper 451*b* respectively have the sloped surfaces formed opposite to each other in a rotation direction, the foreign substance may not fall off the brush in a space F between the first scraper and the second scraper, but may fall off the brush only on an outside G of the first scraper and the second scraper.

As a result, breakage of the filter can be prevented. Moreover, by preventing the foreign substance from falling off the brush at a filter region F, where much foreign substance can accumulate due to the position of the fan and cleaning is performed intensively by the brush, and by storing the foreign substance in a filter region G, where a relatively small amount of foreign substance is accumulated and cleaning is not performed as intensively, an air filtering efficiency of the filter assembly is improved.

Moreover, the first scraper 451*a* and the second scraper 451*b* may also be provided at boundaries of the filter region F where the cleaning is made intensively and the filter region G where the cleaning is not made intensively, respectively.

Since the foreign substance is separated from the brush 440 at the first scraper 451*a* and the second scraper 451*b*, if the first scraper 451*a* and the second scraper 451*b* are provided at boundaries of the filter region F where the cleaning is made intensively and the filter region G where the cleaning is not made intensively respectively, by preventing the foreign substance from remaining at the region F where the foreign substance accumulates much, the drying efficiency can be improved.

Additionally, the curved radial frame 451 enables gradual foreign substance separation of the scraper from the brush, to spread accumulation of the foreign substance on the bottom 413 of the case.

Figure 13:
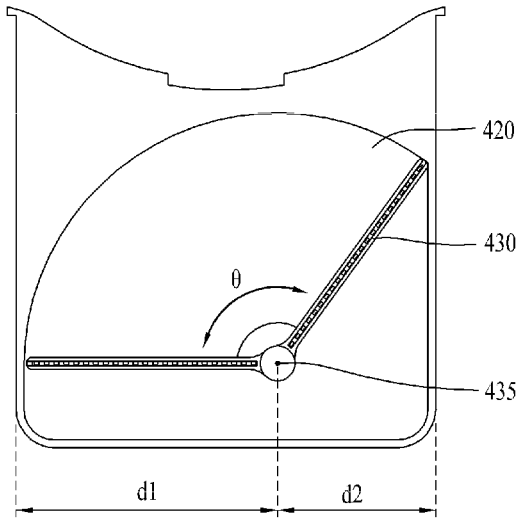
FIG. 13 illustrates a schematic view showing a rotation center and a working area of the brush frame on the filter portion.

FIG. 13 illustrates a range of rotational movement of the brush frame. As shown in FIG. 13, the rotational movement of the brush frame 430 can be confined within a portion of the filter portion 420.

The filter portion 420 can have a partial circular shape in reference to the rotational axis of the brush frame 430 that is positioned at the rotation center 435, and the brush frame 430 can have a length that I substantially the same with a maximum radius of the circle that can be formed at the filter portion. The brush frame can reciprocate within a predetermined angle θ set in advance with reference to the rotation center 435. As illustrated, a range of rotational movement of the brush frame 430 from a vertical position toward one side of the case is greater than a range of rotational movement of the brush frame 430 from the vertical position toward the other side of the case.

Figure 14:
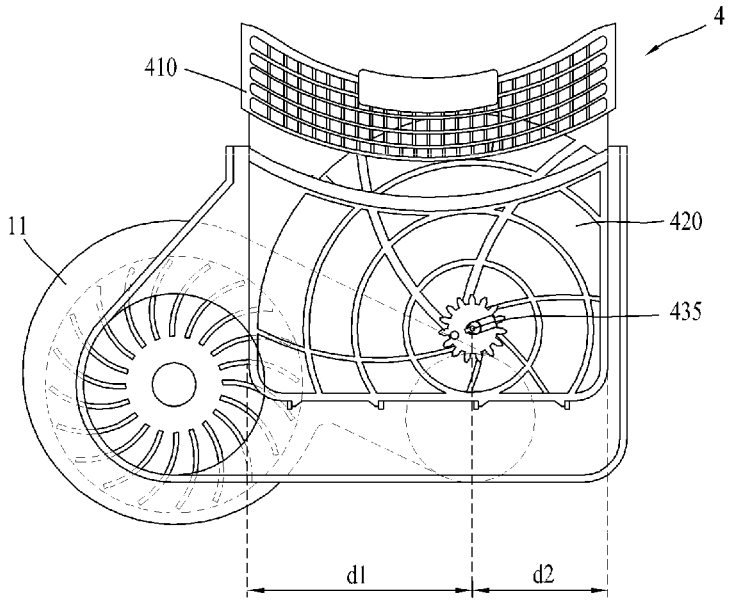
FIG. 14 illustrates a schematic view showing a position of the filter assembly relative to a fan.

In this case, the rotation center 435 of the brush frame is positioned at a point having a distance d1 from a first side of the case that is longer than a distance d2 from a second side of the case. In other words, as shown in FIG. 14, the rotation center 435 of the brush frame can be positioned at a point having a distance d1 from a side of the case closer to the fan 11 that is longer than a distance d2 of the other side of the case. As shown, the first and second sides of the case are positioned at opposite horizontal ends of the case. Accordingly, the rotational axis of the brush frame can be horizontally offset with respect a vertical center line of the filter portion 420.

This may help sustain a high flow rate of the air passing through the filter and improving filter cleaning efficiency by determining a shape of the filter portion and a working range of the brush while taking the position of the fan into account.

That is, according to the result of an experiment, the flow rate of air passing through the filter when the position of the fan is offset with respect to a vertical center line of the filter portion and the rotational axis of the brush frame is provided to be closer to the fan is higher than the flow rate of air when the rotational axis of the brush frame is provided in the vertical center line of the filter portion.

Figure 15:
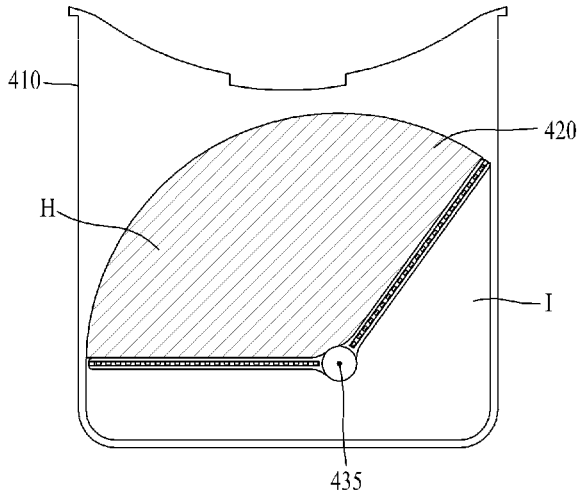
FIGS. 15 and 16 illustrate schematic views showing a filter cleaning region and a foreign substance compression region formed in the filter portion, respectively.

FIG. 15 illustrates a portion of the filter through which the air passes intensively as influenced by the fan 11.

Referring to FIG. 15, the fan 11 increases an area of a filter portion H through which the air from the drum passes relatively intensively, and decreases an area of the filter portion I through which the air from the drum passes relatively sparsely.

The filter portion 420 may be divided into a filter cleaning region where the brush frame makes rotary reciprocating movement and a foreign substance, or lint, compression region where the foreign substance fallen off the filter portion is accumulated. The filter cleaning region is a hatched portion H in FIG. 15, which is a portion brought into contact with the brush to separate the foreign substance from the filter to be cleaned.

The foreign substance compression region is shown as a portion I without the hatching, in which the brush 440 is not brought into contact with the filter portion 420, making the foreign substance separated from the brush 440 by the scraper to accumulate on the bottom 413 of the case. Moreover, in the foreign substance compression region, the foreign substance accumulated on the bottom 413 is compressed by the brush frame 430.

This is for increasing an area of the filter portion H which is susceptible to accumulation of the foreign substance due to concentration of an air flow, as well as intensive cleaning of the filter portion H having much accumulation of the foreign substance with the brush 440, thereby improving the drying efficiency of the dryer.

As also shown in FIG. 15, at least a portion of the foreign substance compression region I is formed above the rotation center 435, or rotational axis, of the brush frame. Additionally, at least a portion of the foreign substance compression region I is formed below the rotational axis of the brush frame. This is for securing an adequate foreign substance compression region where the brush does not clean at a portion of the filter portion on a side of the case far from the fan where the air flow is sparse. In some cases, an area of the foreign substance compression region I located on one side of the rotational axis of the brush frame is less than an area of the foreign substance compression region I located at an opposite side of the rotational axis.

Therefore, despite an offset of the rotation center 435 of the brush frame to a side of the case far from the fan 11, an adequate space for accumulation of the foreign substance can be secured.

Additionally, by utilizing the filter portion which gives small influence to the air flow rate due to the relative sparse air flow as a foreign substance storage and compression space, the spatial efficiency of the filter assembly 4 can be enhanced.

As described above, a filter portion cleaning period can be increased because the brush 440 not only cleans the filter portion 420 more effectively but also compresses the foreign substance accumulated on the bottom 413 to store the foreign substance compressed.

Figure 16:
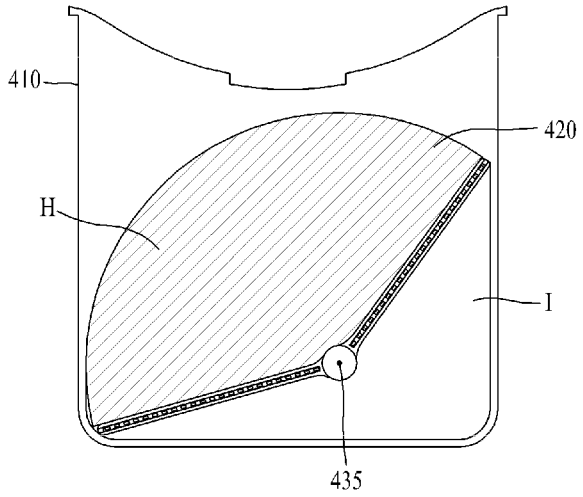
Figure 17:
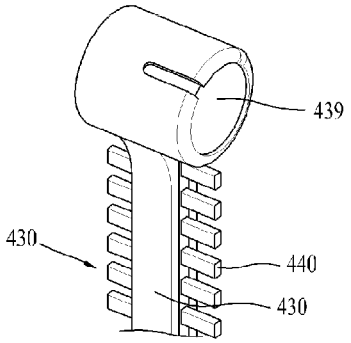
FIG. 17 illustrates a perspective view showing magnetic force generating means provided to a brush frame.

In some cases, at least a portion of the filter cleaning region H may be provided below the rotation center 435, rotational axis, of the brush frame. FIG. 16 illustrates an example in which a portion of the filter cleaning region H is positioned below the rotation center 435 of the brush frame. By enlarging a region of the filter portion 420 having a high air flow rate as the region is close to the fan, the filter assembly provided to the dryer can be expected to have a flow rate increasing effect.

Moreover, the first scraper 451*a* and the second scraper 451*b* may also be provided at boundaries of the filter cleaning region H and the foreign substance compression region I, respectively. Since the foreign substance is separated from the brush 440 at the first scraper 451*a* and the second scraper 451*b*, if the first scraper 451*a* and the second scraper 451*b* are provided at boundaries of the filter cleaning region H and the foreign substance compression region I, the brush frame 430 or the brush 440 can compress the foreign substance stored in the foreign substance compression region I more effectively.

In some implementations, the brush frame 430 may further include magnetic force generating means 439, such as magnets. The magnetic force generating means 439 can be a permanent magnet or an electric magnet that is supported at an end of the brush frame 430.

In this case, the case 410 may have magnetic force sensing means provided thereto additionally for sensing movement of the brush frame 430 by sensing a position of the magnetic force generating means 439.

Figure 18:
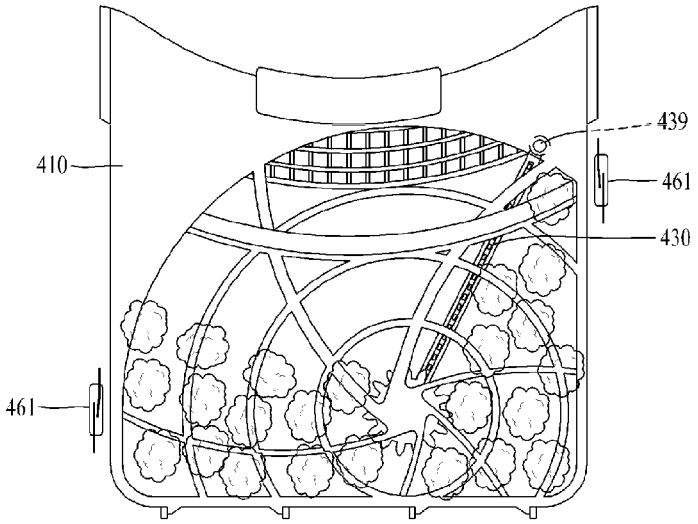
FIG. 18 illustrates a schematic view showing a lead switch for sensing movement of the brush frame in FIG. 17.

Referring to FIG. 18, the magnetic force sensing means may include any type of sensors, such as lead switches 461 that are provided to the case 410 at limiting points D, i.e. end points of the range of rotational movement of the brush frame 430. The lead switch 461 is activated when the magnetic force generating means approaches and can thusly sense movement of the brush 440 or the brush frame 430.

As a result, the filter assembly 4 provided to the dryer can determine an amount of the foreign substance stored in the filter assembly.

For example, referring to FIG. 18, if the foreign substance is accumulated in the case 410, the brush frame 430 fails to reach to the limiting points D on both sides of the rotary reciprocating movement range. In this case, the lead switch 461 fails to sense the magnetic force generating means 439 provided to the brush frame, and, from this, a control unit, such as a controller or the like, that is connected to the lead switch can determine whether the filter assembly is filled with the foreign substance or not.

Moreover, the filter assembly provided to the dryer can even detect a fault, such as inability of rotation of the brush frame, by using the above configuration.

Figure 19:
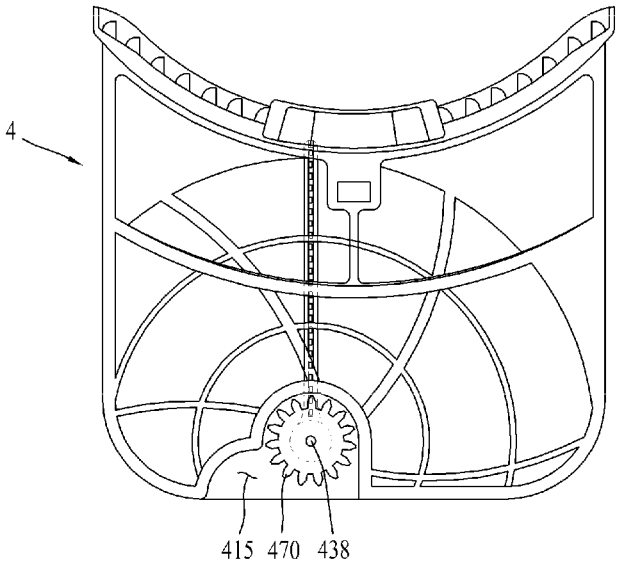
FIG. 19 illustrates a schematic view showing a brush driving gear mounted to the case of the filter assembly.
Figure 21:
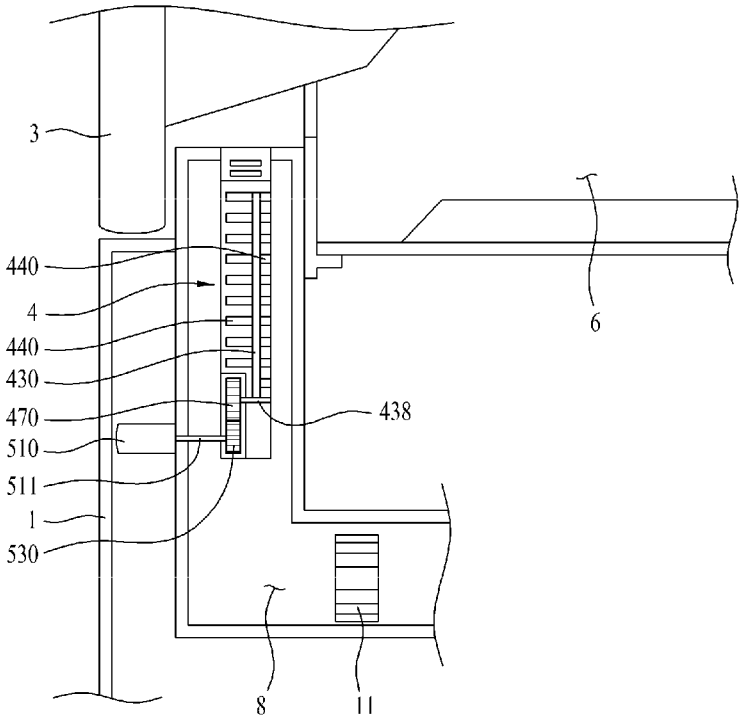
FIGS. 21 and 22 illustrate schematic views showing structures for transmission of power to a brush driving gear, respectively.

Referring to FIG. 19, the brush frame 430 has a rotation shaft 438 provided with a brush driving gear 470. The brush driving gear 470 can move the brush frame 430 as the brush driving gear 470 is engaged with a motor gear 530 that is coupled to a rotation shaft 511 of a driving motor 510 (FIG. 21).

FIG. 19 illustrates a state in which the brush driving gear 470 is mounted to the case 410.

Referring to FIG. 19, a gear seating portion 415 can be formed at the case 410 or one of the first case and the second case. The gear seating portion 415 is a portion formed as an outside of the case and is recessed inwardly. For example, the gear seating portion 415 in the first case can be protruding toward the second case, and vice versa. The brush driving gear is seated in the gear seating portion.

Figure 20:
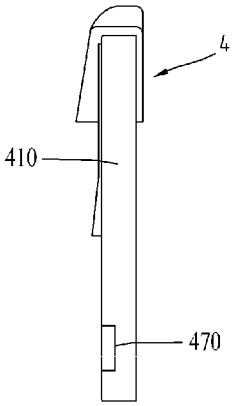
FIG. 20 illustrates a schematic view showing the brush driving gear in FIG. 19 mounted to a case seen from a side of the case.

FIG. 20 illustrates a side view of the case 410 in a state in which the brush driving gear 470 is seated in the gear seating portion 415 in the case 410. As shown in FIG. 20, the brush driving gear 470 seated in the gear seating portion is positioned below an outside surface of at least the case 410, the first case, or the second case.

This configuration can help prevent an element of the dryer from breaking or the brush driving gear from breaking as the brush driving gear 470 hits the element when the filter assembly is mounted to the dryer (When the filter assembly is placed in or taken out of the air discharge duct 8).

Referring to FIG. 21, the brush driving motor 510 is provided to an outside of the air discharge duct 8 to have the rotation shaft 511 of the brush driving motor 510 passed through the air discharge duct 8, and the motor gear 530 is positioned in the air discharge duct 8 fixedly secured to the rotation shaft 511.

In this case, it is preferable that the motor gear 530 is provided, not only to a position to enable to engage with the brush driving gear 470 if the filter assembly 4 is placed in the air discharge duct 8, but also to be seated in the gear seating portion 415.

In some cases, it may be preferable that a rotation axis of the brush driving gear 470 and a rotation axis of the motor gear 530 are spaced a predetermined angle.

Figure 22:
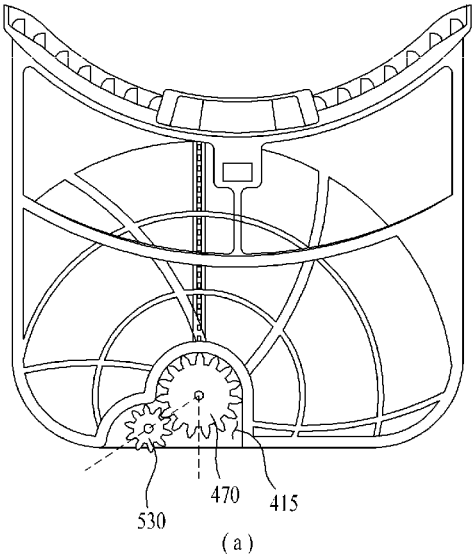
Figure 22:
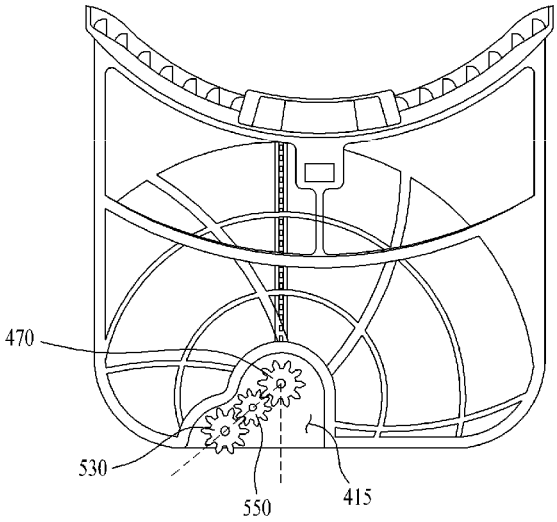

That is, referring to FIG. 22A, a straight line connecting the rotation axis of the brush driving gear 470 and the rotation axis of the motor gear 530 may be provided tilted a predetermined angle from a direction of placement of the filter assembly 4 into the air discharge duct 8.

Therefore, it may be preferable that, if the filter assembly 4 is placed into the air discharge duct 8 in a direction vertical to ground, the straight line connecting the rotation axis of the brush driving gear 470 and the rotation axis of the motor gear 530 is tilted a predetermined angle from a straight line vertical to the ground.

This can prevent the brush driving gear 470 and the motor gear 530 from becoming damaged when the filter assembly 4 is placed into the air discharge duct 8.

If the straight line connecting the rotation axis of the brush driving gear 470 and the rotation axis of the motor gear 530 is provided parallel to the direction of placing the filter assembly 4 into the air discharge duct 8, though there is a risk of hitting teeth of the brush driving gear 470 and teeth of the motor gear 530 to damage the gear teeth when the filter assembly 4 is placed into the air discharge duct 8, if the gears 470 and 530 are arranged as shown in FIG. 22A, above problem can be prevented.

On the other hand, the brush driving gear 470 and the motor gear 530 may be coupled through a connection gear 550. This is for transmission of power from the brush driving motor 510 to the brush driving gear 470 if the brush driving motor 510 is positioned far from the brush driving gear 470.

In this case, the connection gear 550 may be rotatably secured to the gear seating portion 415, or to the air discharge duct 8.

When the connection gear 550 is rotatably provided to the gear seating portion 415, if a straight line connecting a rotation axis of the connection gear 550 and a rotation axis of the motor gear 530 is tilted a predetermined angle from the straight line vertical to ground, damage to the gears can be prevented when the filter assembly 4 is placed into the air discharge duct 8.

Additionally, when the connection gear 550 is rotatably secured to an inside of the air discharge duct 8, if a straight line connecting a rotation axis of the connection gear 550 and a rotation axis of the brush driving gear 470 is tilted a predetermined angle from the straight line vertical to ground can damage to the gears can be prevented when the filter assembly 4 is placed into the air discharge duct 8.

It will be apparent that modifications and variations can be made from the disclosed examples while remaining true to the implementations described. Thus, it is intended that the described implementations include modifications and variations of the disclosed examples.

What is claimed is:

1. A dryer comprising:

a cabinet;

a drum rotatably provided in the cabinet;

a duct that defines a flow passage for air exiting the drum; and a filter assembly located at a position relative to the flow passage and contacting air that has exited the drum, wherein the filter assembly includes:

a case defining the filter assembly, a filter portion configured to filter foreign substance from the air contacting the filter assembly, a brush frame configured for rotational movement relative to the case about a rotational axis, and a brush that is supported by the brush frame and configured to separate the foreign substance from the filter portion, wherein a first distance from a first side of the case to the rotational axis of the brush frame is longer than a second distance from a second side of the case to the rotational axis of the brush frame.

2. The dryer according to claim 1, wherein the first and second sides of the case are on opposite horizontal ends of the case.

3. The dryer according to claim 1, further comprising a fan located at a position relative to the flow passage and configured to discharge air that has contacted the filter assembly, the fan being positioned closer to the first side of the case than the second side of the case.

4. The dryer according to claim 1, wherein the filter portion includes a filter cleaning region within which the rotational movement of the brush frame is confined, and a foreign substance compression region configured to receive the foreign substance that has separated from the filter portion.

5. The dryer according to claim 4, wherein a first area of the foreign substance compression region located on a first side of the rotational axis is less than a second area of the foreign substance compression region located at a second side of the rotational axis.

6. The dryer according to claim 4, wherein at least a portion of the foreign substance compression region is located above the rotational axis of the brush frame, and wherein at least a portion of the foreign substance compression region is located below the rotational axis of the brush frame.

7. The dryer according to claim 1, wherein the filter portion has a circular shape with a center located at the rotational axis of the brush frame, and wherein a length of the brush frame is substantially equal to a radius of the filter portion.

8. The dryer according to claim 1, further comprising:

a magnet supported by the brush frame;

a first sensor supported by the case, located at a first end point of a range of rotational movement of the brush frame, and configured to sense a magnetic force generated by the magnet; and a second sensor supported by the case, located at a second end point of the range of rotational movement of the brush frame, and configured to sense the magnetic force generated by the magnet.

9. The dryer according to claim 1, further comprising a plurality of radial frames extending radially outward from the rotational axis of the brush frame, wherein at least two of the plurality of radial frames each include a plurality of projections spaced apart from one another along a length of the radial frame, the plurality of projections being configured to separate the foreign substance from the brush.

10. The dryer according to claim 9, wherein each of the plurality of projections on a first radial frame includes a first sloped surface and each of the plurality of projections on a second radial frame includes a second sloped surface, the first and second sloped surfaces being oriented to substantially face each other.

11. The dryer according to claim 1, wherein the case includes a first case portion having a first filter portion, and a second case portion having a second filter portion, the first and second case portions being configured to face each other and define a space therebetween, the brush frame being configured to rotate within the space, and wherein the brush is provided on opposite sides of the brush frame to separate the foreign substance from both the first and second filter portions.

12. The dryer according to claim 11, wherein the brush frame defines grooved seating portions on opposite sides, and wherein the brush includes a body portion configured to be seated within the seating portion and a plurality of brush projections projecting outward from the body portion, the plurality of brush projections being spaced apart from one another at predetermined intervals.

13. The dryer according to claim 11, wherein the brush frame includes a rotation shaft along the rotational axis, and wherein a surface of one of the first and second case portions includes a gear seating portion protruding toward the other of the first and second case portions, a brush driving gear being seated in the gear seating portion and attached to the rotation shaft.

14. The dryer according to claim 13, further comprising:

a brush driving motor; and a motor gear coupled to a rotation shaft of the brush driving motor and further coupled to the brush driving gear, wherein a straight line connecting a rotational axis of the brush driving gear and a rotational axis of the motor gear is oriented at a predetermined angle with respect to a straight line vertical to the ground.

15. The dryer according to claim 1, wherein the rotational axis of the brush frame is horizontally offset with respect to a vertical center line of the filter portion.

16. The dryer according to claim 1, wherein a first range of rotational movement of the brush frame from a vertical position toward a first side of the case is greater than a second range of rotational movement of the brush frame from the vertical position toward a second side of the case.

17. A dryer comprising:

a cabinet;

a drum rotatably provided in the cabinet;

a duct that defines a flow passage for air exiting the drum; and a filter assembly located at a position relative to the flow passage and contacting air that has exited the drum, wherein the filter assembly includes:

a case defining the filter assembly, a filter portion configured to filter foreign substance from the air contacting the filter assembly, a brush frame configured for rotational movement relative to the case about a rotational axis, and a brush that is supported by the brush frame and configured to separate the foreign substance from the filter portion, wherein the rotational axis of the brush frame is horizontally offset with respect to a vertical center line of the filter portion.

18. A dryer comprising:

a cabinet;

a drum rotatably provided in the cabinet;

a duct that defines a flow passage for air exiting the drum; and a filter assembly located at a position relative to the flow passage and contacting air that has exited the drum, wherein the filter assembly includes:

a case defining the filter assembly, a filter portion configured to filter foreign substance from the air contacting the filter assembly, a brush frame configured for rotational movement relative to the case about a rotational axis, and a brush that is supported by the brush frame and configured to separate the foreign substance from the filter portion, wherein a first range of rotational movement of the brush frame from a vertical position toward a first side of the case is greater than a second range of rotational movement of the brush frame from the vertical position toward a second side of the case.

19. A dryer comprising:

a cabinet;

a drum rotatably provided in the cabinet;

a duct that defines a flow passage for air exiting the drum; and a filter assembly located at a position relative to the flow passage and contacting air that has exited the drum, wherein the filter assembly includes:

a case defining the filter assembly, a filter portion configured to filter foreign substance from the air contacting the filter assembly, the filter portion having a filter cleaning region and a foreign substance compression region, a brush frame configured for rotational movement relative to the case about a rotational axis, the rotational movement of the brush frame being confined within the filter cleaning region, and a brush that is supported by the brush frame and configured to separate the foreign substance from the filter portion, wherein the foreign substance compression region is configured to receive the separated foreign substance, and wherein a first area of the foreign substance compression region located on a first side of the rotational axis is less than a second area of the foreign substance compression region located at a second side of the rotational axis.

20. A dryer comprising:

a cabinet;

a drum rotatably provided in the cabinet;

a duct that defines a flow passage for air exiting the drum; and a filter assembly located at a position relative to the flow passage and contacting air that has exited the drum, wherein the filter assembly includes:

a case defining the filter assembly, a filter portion configured to filter foreign substance from the air contacting the filter assembly, the filter portion having a filter cleaning region and a foreign substance compression region, a brush frame configured for rotational movement relative to the case about a rotational axis, the rotational movement of the brush frame being confined within the filter cleaning region, and a brush that is supported by the brush frame and configured to separate the foreign substance from the filter portion, wherein the foreign substance compression region is configured to receive the separated foreign substance, wherein at least a portion of the foreign substance compression region is located above the rotational axis of the brush frame, and wherein at least a portion of the foreign substance compression region is located below the rotational axis of the brush frame.

* * * * *